US007992600B2

(12) United States Patent
Liu

(10) Patent No.: US 7,992,600 B2
(45) Date of Patent: Aug. 9, 2011

(54) APPARATUS FOR FILLING A MOTOR VEHICLE COOLING SYSTEM

(76) Inventor: Lai-Cheng Liu, Taichung (TW)

( * ) Notice: Subject to any disclaimer, the term of this patent is extended or adjusted under 35 U.S.C. 154(b) by 453 days.

(21) Appl. No.: 12/353,935

(22) Filed: Jan. 14, 2009

(65) Prior Publication Data

US 2010/0175780 A1 Jul. 15, 2010

(51) Int. Cl.
*B65B 31/04* (2006.01)

(52) U.S. Cl. ..... 141/65; 141/59; 141/96; 141/98

(58) Field of Classification Search ..... 141/7, 59, 141/65, 94–96, 98
See application file for complete search history.

(56) References Cited

U.S. PATENT DOCUMENTS 2,399,300 A * 4/1946 Stewart et al. ..... 137/205
2,784,731 A * 3/1957 Bealer ..... 137/505.11
4,235,100 A * 11/1980 Branchini ..... 73/49.7
5,069,062 A * 12/1991 Malecek et al. ..... 73/49.7
5,201,213 A * 4/1993 Henning ..... 73/49.2
5,329,982 A * 7/1994 Payne ..... 165/95
5,427,505 A * 6/1995 Payne ..... 417/149
5,649,574 A * 7/1997 Turcotte et al. ..... 141/67
6,152,193 A * 11/2000 Klamm ..... 141/98
D441,675 S * 5/2001 Trigiani et al. ..... D10/101
6,234,215 B1 * 5/2001 Klamm ..... 141/1
6,318,155 B1 * 11/2001 Carr ..... 73/49.7
6,360,790 B1 * 3/2002 Klamm et al. ..... 141/98
6,584,994 B2 * 7/2003 Knowles et al. ..... 137/14
6,782,926 B1 * 8/2004 Hughes ..... 141/98
6,959,717 B2 * 11/2005 Knowles et al. ..... 137/14
7,614,283 B2 * 11/2009 Allen et al. ..... 73/49.7

* cited by examiner

*Primary Examiner* — Christopher Kim

(57) ABSTRACT

The apparatus for filling a motor vehicle cooling system includes a communication body, a valve, a flexible connecting hose, a pressure gauge, a relief valve and a hanging portion, in which the valve, the connecting hose, the pressure gauge, the relief valve and the hanging portion are all disposed on predetermined positions of the communication body, while the connecting hose is extended out of the communication body for a distance and it connects to a top opening of the cooling system tightly by a metallic cap.

5 Claims, 4 Drawing Sheets

APPARATUS FOR FILLING A MOTOR VEHICLE COOLING SYSTEM

BACKGROUND OF THE INVENTION

1. Field of the Invention

The present invention relates to an apparatus for filling a motor vehicle cooling system, and particularly to an apparatus that the coolant is drawn by the vacuum created in a cooling system after evacuating air therefrom.

2. Description of the Prior Art

As shown in Taiwan patent No. M249880, a conventional apparatus for filling a cooling system is connected to a top opening of an engine cooling system by an enlargeable plastic cap thereof. However, the connection between the cooling system and the cap is unsatisfyingly instable, i.e. the connection could be broken by an accidental crash, which causes great trouble of the users.

SUMMARY OF THE INVENTION

The main object of the present invention is to provide an apparatus to tightly cover the top opening of a cooling system.

To achieve the above object, the apparatus of the present invention includes a communication body, a valve, a flexible connecting hose, a pressure gauge, a relief valve and a hanging portion, in which the valve, the connecting hose, the pressure gauge, the relief valve and the hanging portion are all disposed on predetermined positions of the communication body, while the connecting hose is extended out of the communication body for a distance and it connects to a top opening of the cooling system tightly by a metallic cap.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
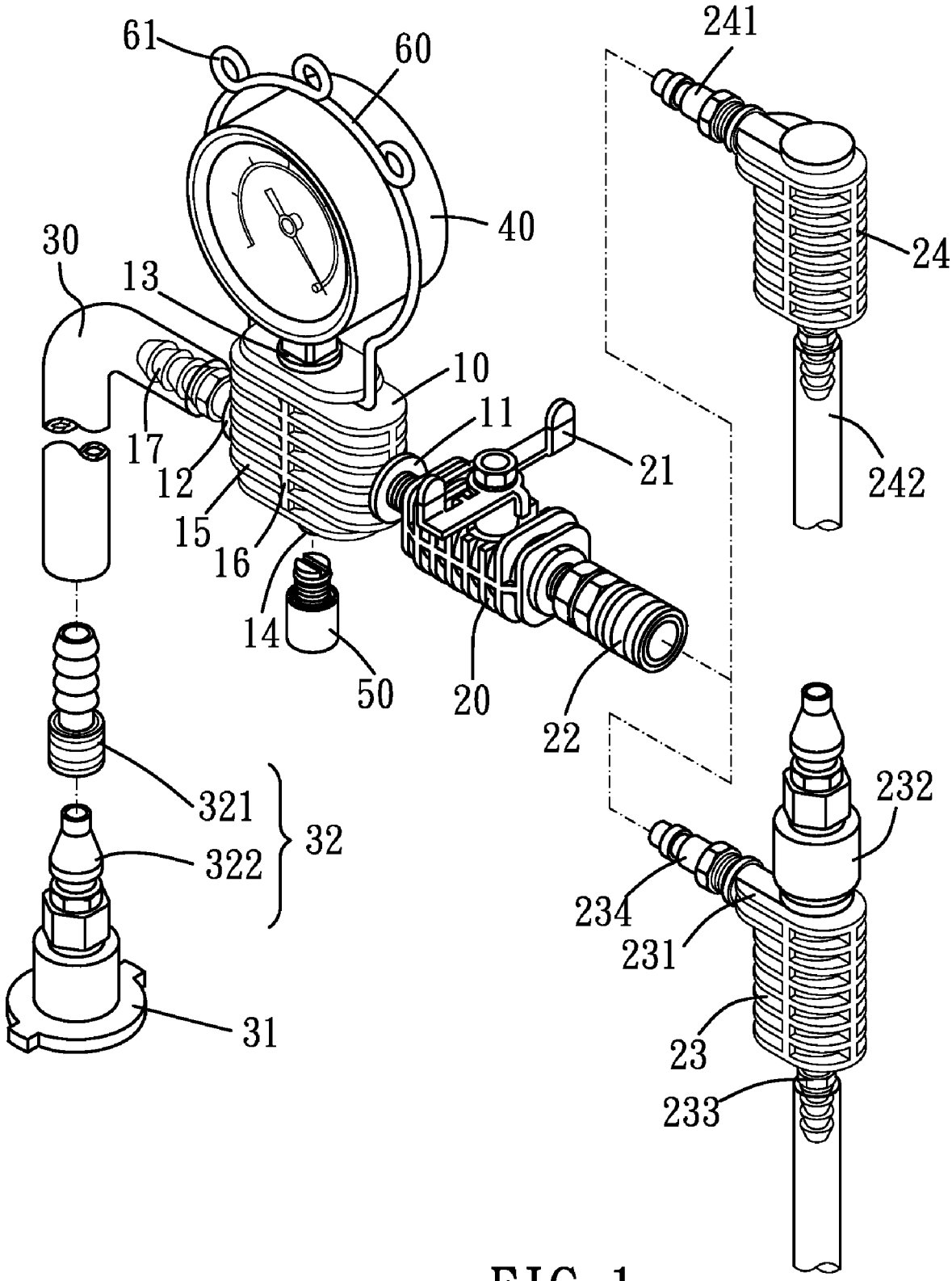
FIG. 1 is a schematic drawing showing an apparatus in accordance with a preferred embodiment of the present invention.

Please refer to FIG. 1. The apparatus of the present invention includes a communication body 10, a valve 20, a flexible connecting hose 30, a pressure gauge 40, a relief valve 50 and a hanging portion 60. The communication body 10 includes a horizontal through hole and a vertical through hole communicating with each other. The horizontal through hole has a first end 11 and a second end 12, and the vertical through hole has a third end 13 and a fourth end 14. In addition, there are a plurality of horizontal ribs 15 and vertical ribs 16 disposed around an outer surface of the communication body 10 to form square structures to increase the mechanical strength of the communication body 10.

Figure 2:
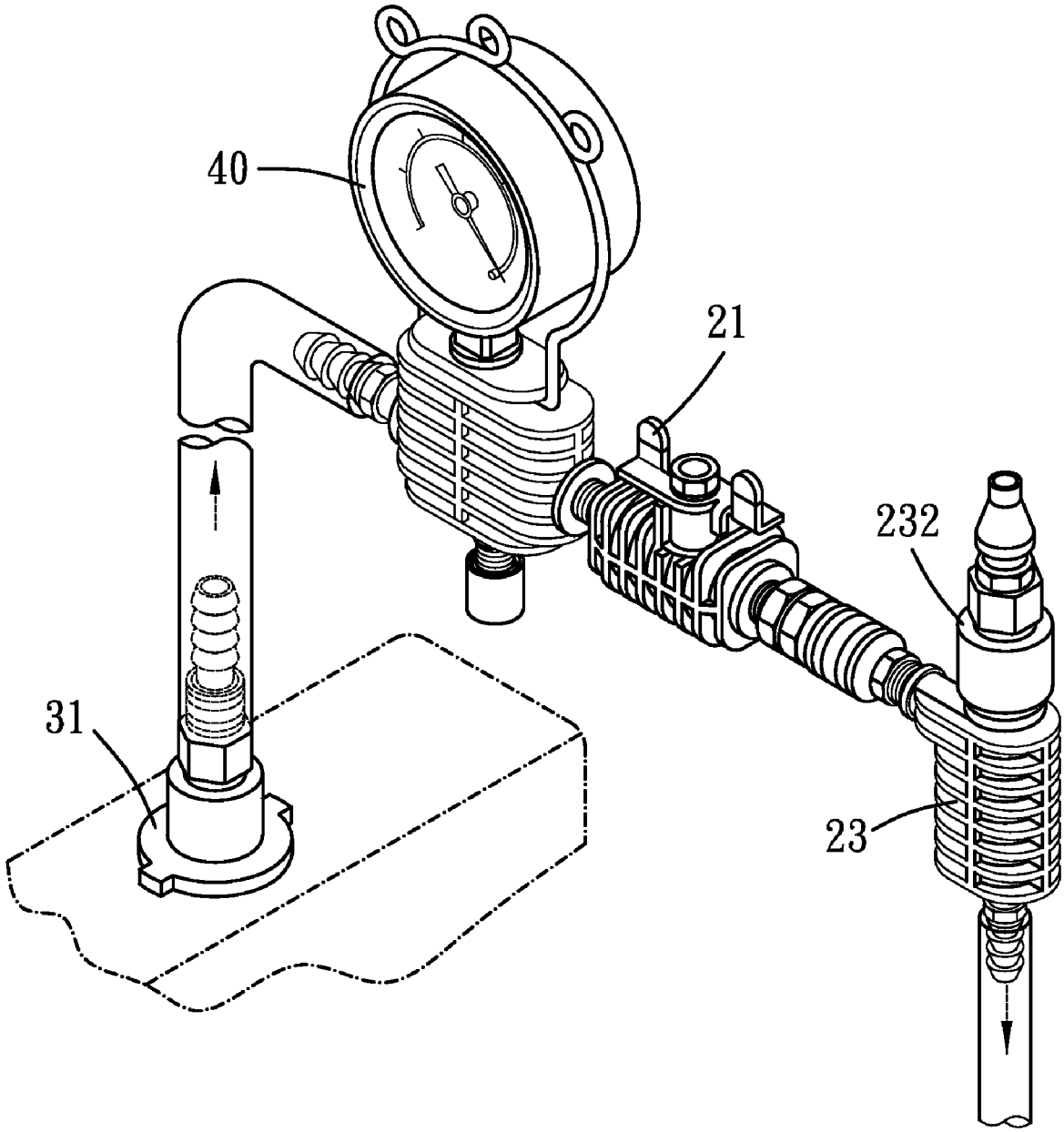
FIG. 2 is a first diagram showing a usage state of an apparatus in accordance with a preferred embodiment of the present invention.

Furthermore, the valve 20 has an inner passage and a switch 21 for selectively opening or closing the inner passage. One end of the valve 20 connects to the first end 11 of the communication body 10, communicating the inner passage with the horizontal through hole. On another end of the valve 20 is disposed a first quick release female coupling 22. In other words, the communication between an aperture within the first quick release female coupling 22 and the horizontal through hole is broken when the switch 21 is in its closed position (as shown in FIG. 1); and the communication therebetween is maintained when the switch 21 is in its open position (as shown in FIG. 2).

The connecting hose 30 extends out of the communication body 20 for a distance, and it is made of plastic material, i.e. PVC, with flexibility. Therefore, the connecting hose 30 comes in handy in the crowded motor vehicle engine room. One end of the connecting hose 30 connects to the second end 12 of the communication body 10 and communicates with the horizontal through hole, and another end thereof is disposed a metallic cap 31 for tightly covering a top opening of the cooling system such as a radiator or a recovery tank thereof. In the present embodiment, a metallic adaptor 17 is installed on the second end 12 to couple with the end of the connecting hose 30, and a quick release assembly 32 is disposed between the cap 31 and the connecting hose 30. The quick release assembly 32 includes a second quick release female coupling 321 and a third quick release male coupling 322 for detachably connecting to the second quick release female coupling 321. the second quick release female coupling 321 is installed on the end of the connecting hose 30 away from the communication body 10, and the third quick release male coupling 322 is installed on the cap 31. Accordingly, the users can replace the cap 31 with another, which is with suitable dimension corresponding to the opening of the radiator. In addition, the cap 31 is 'locked' on the opening such that the connection between the cap 31 and the radiator is much more tightened than a conventional plastic cap can achieve. The cap 31 is especially made of metallic material so that it is rigid and durable to bear the great pressure difference caused by the vacuum.

Moreover, the pressure gauge 40 is disposed on the third end 13 of the communication body 10 to determine the pressure within the through holes. The relief valve 50 is disposed on the fourth end 14 of the communication body 10 for adjusting the pressure difference between the through holes and the surrounding. In addition, the hanging portion 60 is disposed on a predetermined position of the communication body 10 so that the communication body 10 can be hung onto the hood or anywhere suitable. Therefore, when the apparatus of the present invention is in use, the users won't have to hold the apparatus so as to take care of other operations. Preferably, the hanging portion 60 is made of metallic material and it is integrally formed with a plurality of hanging circles 61 in a bending manner.

In the present invention, the first quick release female 22 can be selectively connected to an evacuation adaptor 23 or a water drawing adaptor 24. The evacuation adaptor 23 includes a sucking end 231, and inlet 232 and an outlet 233 which communicate with each other. On the sucking end is disposed a first quick release male coupling 234 to couple with the first quick release female coupling 22. The inlet 232 is connected to a compression air source such as a compressor, while the outlet 233 is for evacuating air therefrom. Furthermore, on one end the water drawing adaptor 24 is disposed a second quick release male coupling 241 to couple with the first quick release female coupling 22, and a water drawing hose 242 is attached to another end thereof.

Figure 3:
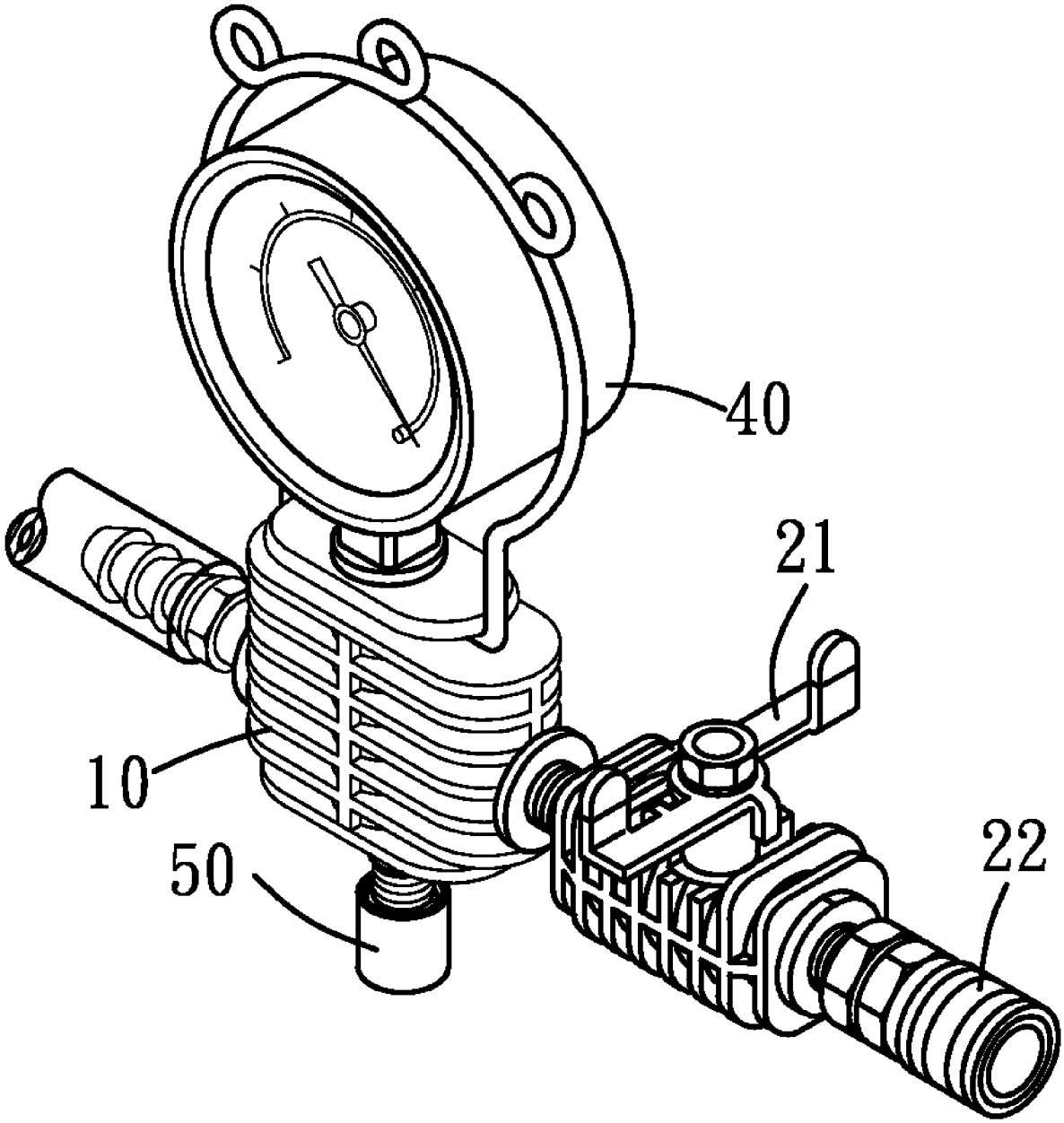
FIG. 3 is a second diagram showing a usage state of an apparatus in accordance with a preferred embodiment of the present invention.
Figure 4:
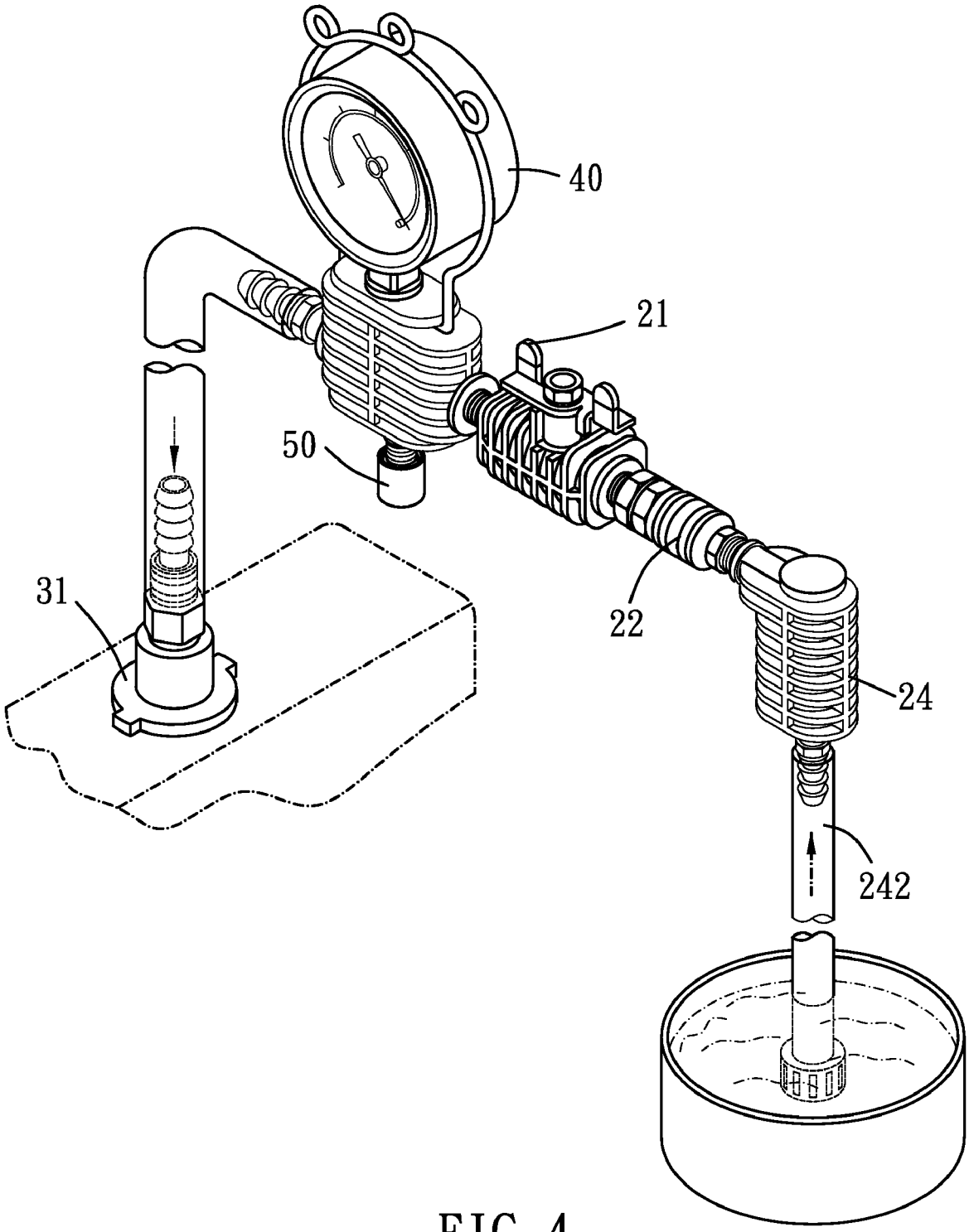
FIG. 4 is a third diagram showing a usage state of an apparatus in accordance with a preferred embodiment of the present invention.

Please refer to FIG. 2 to FIG. 4 for the usage status of the present invention. Now refer to FIG. 2 first. The first quick release female coupling 22 is connecting with the evacuation adaptor 23, and the inlet 232 is connecting to a compressor. Meanwhile, the cap 31 is air-tightly locked on a top opening of the radiator (if there is a recovery tank, the cap 31 will be locked on the opening thereof), and the switch 21 is on its open position. Accordingly, the sucking end 231 substantially communicates with the interior of the radiator. When the compressor begins to work and the compression air provided thereby flows through the evacuation adaptor 23 from the inlet 232 to the outlet 233, creating a negative pressure at the sucking end 231 to draw air from the radiator. And, the pressure difference between the interior of the radiator and the surrounding can be read on the pressure gauge 40.

When a substantial vacuum is provided in the radiator, the switch 21 is then switched off as shown in FIG. 3, and the evacuation adaptor 23 is released from the first quick release female coupling 22. The users can monitor the pressure gauge to observe whether the pressure changes during a period of a few minutes to see if the radiator is properly sealed.

As shown in FIG. 4, the water drawing adaptor 24 is connected to the first quick release female adaptor 22, and one end of the water drawing hose 242 is sunk into the clean coolant. The switch 21 is then turned opened, and the coolant is drawn in the radiator by the vacuum such that the radiator is filled with clean coolant quickly. The relief valve 50 can be facilitated when adjusting the pressure difference. A possible situation is that the recovery tank needs not to be fully filled with coolant, such that the switch 21 is temporarily turned closed and appropriate amount of air is drawn into the recovery tank via the relief valve 50 when the main tank of the cooling system is full, leaving recovery tank with sustainable empty space.

In summary, the apparatus of the present invention can be hung on the hood to empty the user's hands, and the quick release assembly is disposed between the cap and the connecting hose for the need to install a proper cap in accordance with the dimension of the opening. In addition, the relief valve will comes in useful when some empty space should be left in the recovery tank. Accordingly, the present invention provides the users with a convenient and useful apparatus to fill a motor vehicle cooling system with coolant.

What is claimed is:

1. An apparatus for filling a motor vehicle cooling system with coolant, comprising:

a communication body, comprising a horizontal through hole and a vertical through hole communicating the horizontal through hole, the horizontal through hole having a first end and a second end, and the vertical through hole having a third end and a fourth end, around the outer surface of the communication body being disposed a plurality of horizontal ribs and vertical ribs;

a valve, having an inner passage and a switch for selectively opening or closing the inner passage, one end of the valve connecting to the first end of the communication body, communicating the inner passage with the horizontal through hole, on another end of the valve being disposed a first quick release female coupling;

a flexible connecting hose extending out of the communication body for a distance, one end of the connecting hose connecting to the second end of the communication body and communicating with the horizontal through hole, another end thereof being disposed a metallic cap for tightly covering a top opening of the cooling system;

a pressure gauge, disposed on the third end of the communication body;

a relief valve, disposed on the fourth end of the communication body; and a hanging portion, disposed on a predetermined position of the communication body.

2. The apparatus of claim 1, further comprising an evacuation adaptor, the evacuation adaptor comprising a sucking end, an inlet and an outlet, and the sucking end, the inlet and the outlet communicating with each other, on the sucking end being disposed a first quick release male coupling to couple with the first quick release female coupling.

3. The apparatus of claim 1, further comprising a water drawing adaptor, on one end of the water drawing adaptor being disposed a second quick release male coupling to couple with the first quick release female coupling, and a water drawing hose being attached to another end thereof.

4. The apparatus of claim 1, wherein the hanging portion is made of metallic material, and the hanging portion is integrally formed with a plurality of hanging circles in a bending manner.

5. The apparatus of claim 1, wherein a quick release assembly is disposed between the cap and the connecting hose, the quick release assembly comprises a second quick release female coupling and a third quick release male coupling for detachably connecting to the second quick release female coupling, the second quick release female coupling is installed on the end of the connecting hose away from the communication body, and the third quick release male coupling is installed on the cap.

* * * * *